US008800264B2

(12) United States Patent
Sullivan et al.

(10) Patent No.: US 8,800,264 B2
(45) Date of Patent: Aug. 12, 2014

(54) SAMPLING TUBE FOR IMPROVED EXHAUST GAS FLOW TO EXHAUST SENSOR

(71) Applicants: Raymond J. Sullivan, Royal Oak, MI (US); Mark E. McKackin, Royal Oak, MI (US); Richard L. Lewis, Royal Oak, MI (US); William L. Laga, Fenton, MI (US); Charles S. Payton, Davison, MI (US)

(72) Inventors: Raymond J. Sullivan, Royal Oak, MI (US); Mark E. McKackin, Royal Oak, MI (US); Richard L. Lewis, Royal Oak, MI (US); William L. Laga, Fenton, MI (US); Charles S. Payton, Davison, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 0 days.

(21) Appl. No.: 13/739,145

(22) Filed: Jan. 11, 2013

(65) Prior Publication Data

US 2013/0125533 A1 May 23, 2013

Related U.S. Application Data

(63) Continuation-in-part of application No. 12/943,097, filed on Nov. 10, 2010.

(60) Provisional application No. 61/587,823, filed on Jan. 18, 2012.

(51) Int. Cl.
*F01N 3/00* (2006.01)

(52) U.S. Cl.
USPC ..... 60/276

(58) Field of Classification Search
CPC . F01N 11/00; F01N 13/008; F01N 2560/025; F01N 2470/18; F01N 2340/00
USPC ..... 60/276
See application file for complete search history.

(56) References Cited

U.S. PATENT DOCUMENTS

| | | | | |
|---|---|---|---|---|
| 3,803,921 | A | 4/1974 | Dieterich | |
| 4,534,213 | A | 8/1985 | Mirikidani | |
| 4,597,850 | A * | 7/1986 | Takahasi et al. | 204/426 |
| 5,625,156 | A | 4/1997 | Serrels et al. | |
| 5,762,771 | A | 6/1998 | Yamada et al. | |
| 5,834,657 | A | 11/1998 | Clawson et al. | |
| 6,068,746 | A * | 5/2000 | Kojima et al. | 204/421 |

(Continued)

FOREIGN PATENT DOCUMENTS

EP 0822410 2/1998

*Primary Examiner* — Thomas Denion
*Assistant Examiner* — Jason Shanske
(74) *Attorney, Agent, or Firm* — Ralph E. Smith

(57) ABSTRACT

An exhaust assembly for a vehicle includes an exhaust pipe through which an exhaust gas flows substantially in a first direction. The exhaust pipe includes a central region. The assembly also includes a sensor in fluid communication with the exhaust pipe and an elongated tube extending from a first end toward a second end and disposed at least partially within the exhaust pipe. The first end of the tube receives at least a portion of the sensor. The tube includes an inlet opening and an outlet opening. The inlet opening generally faces the exhaust gas flowing within the central region in the first direction so that some of the exhaust gas flowing in the central region enters the inlet opening. The tube directs the exhaust gas within the tube toward the sensor, and the exhaust gas within the tube flows out of the tube through the outlet opening.

20 Claims, 5 Drawing Sheets

(56) References Cited

U.S. PATENT DOCUMENTS

| | | | | |
|---|---|---|---|---|
| 6,340,809 | B2 * | 1/2002 | Yamada | 219/543 |
| 6,432,288 | B1 | 8/2002 | Nielsen et al. | |
| 6,843,105 | B1 | 1/2005 | France | |
| 7,089,811 | B2 | 8/2006 | Allmendinger | |
| 2006/0153761 | A1 * | 7/2006 | Bandl-Konrad et al. | 423/239.1 |
| 2007/0204597 | A1 * | 9/2007 | Nakano | 60/276 |
| 2008/0209984 | A1 | 9/2008 | Yamada | |
| 2008/0314748 | A1 * | 12/2008 | Yamauchi et al. | 204/431 |
| 2009/0101504 | A1 * | 4/2009 | Yamauchi | 204/424 |
| 2009/0151445 | A1 * | 6/2009 | Hoshika et al. | 73/204.23 |
| 2012/0110982 | A1 * | 5/2012 | McMackin et al. | 60/276 |
| 2013/0125533 | A1 * | 5/2013 | Sullivan et al. | 60/276 |

* cited by examiner

FIG 1
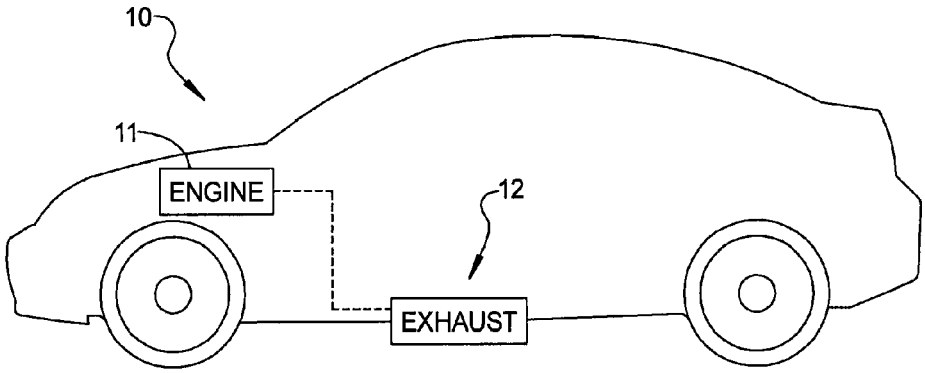
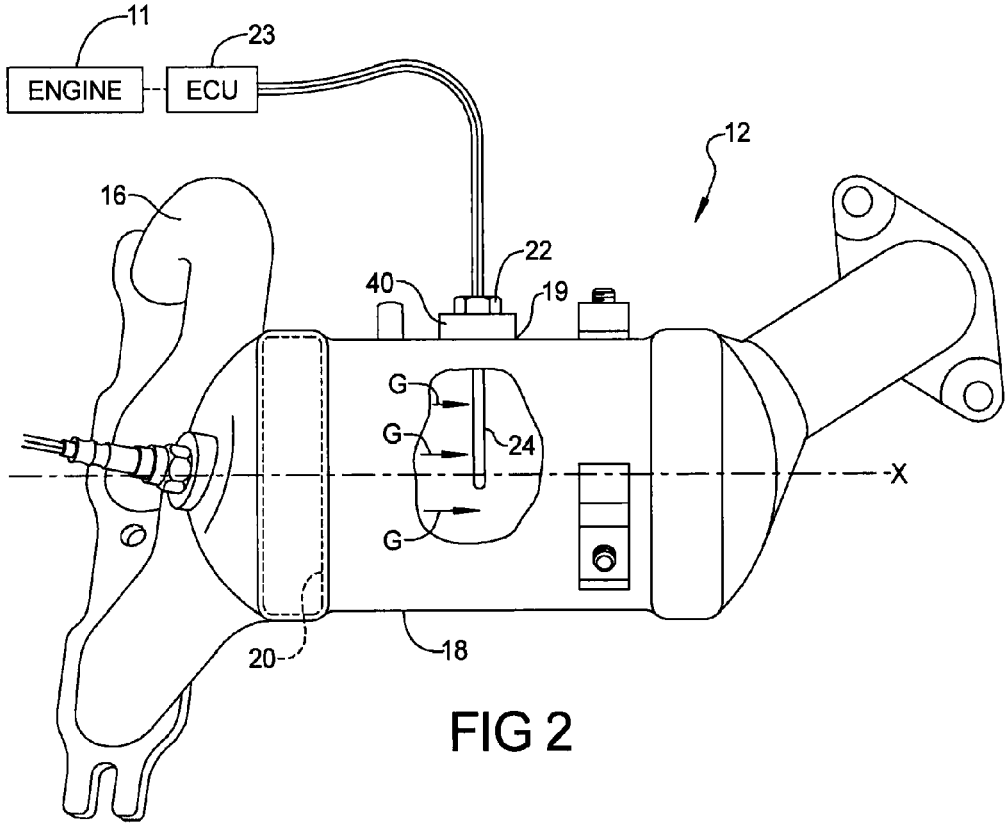
FIG 2

SAMPLING TUBE FOR IMPROVED EXHAUST GAS FLOW TO EXHAUST SENSOR

REFERENCE TO CO-PENDING APPLICATIONS

This application claims the benefit of U.S. Provisional Ser. No. 61/587,823 filed Jan. 18, 2012 and is a Continuation-in-Part of U.S. Ser. No. 12/943,097 filed Nov. 10, 2010, which is incorporated herein, by reference, in its entirety.

FIELD

The following relates to an exhaust system and, more particularly, relates to a sampling tube for improving exhaust gas flow to an exhaust sensor.

BACKGROUND

Vehicle exhaust systems often include one or more sensors for detecting the characteristics of the exhaust gas flowing therein. For instance, exhaust systems typically include one or more oxygen sensors for detecting oxygen content flowing within the exhaust system. These sensors can provide corresponding signals to the engine control unit (ECU), and the ECU can utilize the signals for controlling operation of the engine or for other purposes.

Typically, these sensors extend through an opening in the exhaust pipe and into the flow of exhaust gas. For instance, these sensors are often positioned adjacent the inner wall of the exhaust pipe. Thus, the readings from these sensors can depend on the flow conditions generally adjacent the inner wall of the pipe.

SUMMARY

An exhaust assembly for a vehicle is disclosed that includes an exhaust pipe through which an exhaust gas flows substantially in a first direction. The exhaust pipe includes a central region. The assembly also includes a sensor in fluid communication with the exhaust pipe and an elongated tube extending from a first end toward a second end and disposed at least partially within the exhaust pipe. The first end of the tube receives at least a portion of the sensor. The tube includes an inlet opening and an outlet opening. The inlet opening generally faces the exhaust gas flowing within the central region in the first direction so that flow of the exhaust gas in the central region substantially directly enters the inlet opening. The tube directs the exhaust gas within the tube toward the sensor, and the exhaust gas within the tube flows out of the tube through the outlet opening.

Moreover, an exhaust assembly for a vehicle is disclosed. The exhaust assembly includes an exhaust pipe through which an exhaust gas flows. The exhaust pipe has a central axis and an inner wall surface, and the exhaust pipe includes an opening. The assembly also includes a catalyst member disposed in the exhaust pipe, and an oxygen sensor that is fixed relative to the exhaust pipe. The sensor is disposed adjacent the inner wall surface of the exhaust pipe, and the oxygen sensor is disposed downstream of the catalyst member. The exhaust assembly also includes a tube that is hollow and that has a substantially right circular cylindrical shape, so as to include a first end, a second end, and a substantially straight tube axis. The tube also includes a sidewall that extends along the tube axis. The second end includes an end wall that closes off the second end. The first end is open to receive the sensor. The tube additionally includes an inlet opening in the sidewall adjacent the second end and an outlet opening in the sidewall adjacent the first end. The inlet opening and the outlet opening are disposed on opposite sides of the tube axis. The tube extends through the opening in the exhaust pipe such that both the tube and the sensor extend into the exhaust pipe. The tube is fixed to the exhaust pipe to be disposed downstream from the catalyst member. The tube is cantilevered within the exhaust pipe. The central axis of the exhaust pipe extends through the inlet opening. The tube directs flow of the exhaust gas into the inlet opening, toward the sensor, and out of the tube through the outlet opening.

BRIEF DESCRIPTION OF THE DRAWINGS

FIG. 1 is a schematic view of a vehicle with an exhaust system according to various exemplary embodiments of the present disclosure;

FIG. 2 is a side view of a portion of an exhaust assembly of the vehicle of FIG. 1 with portions removed for purposes of clarity;

DETAILED DESCRIPTION

Figure 3:
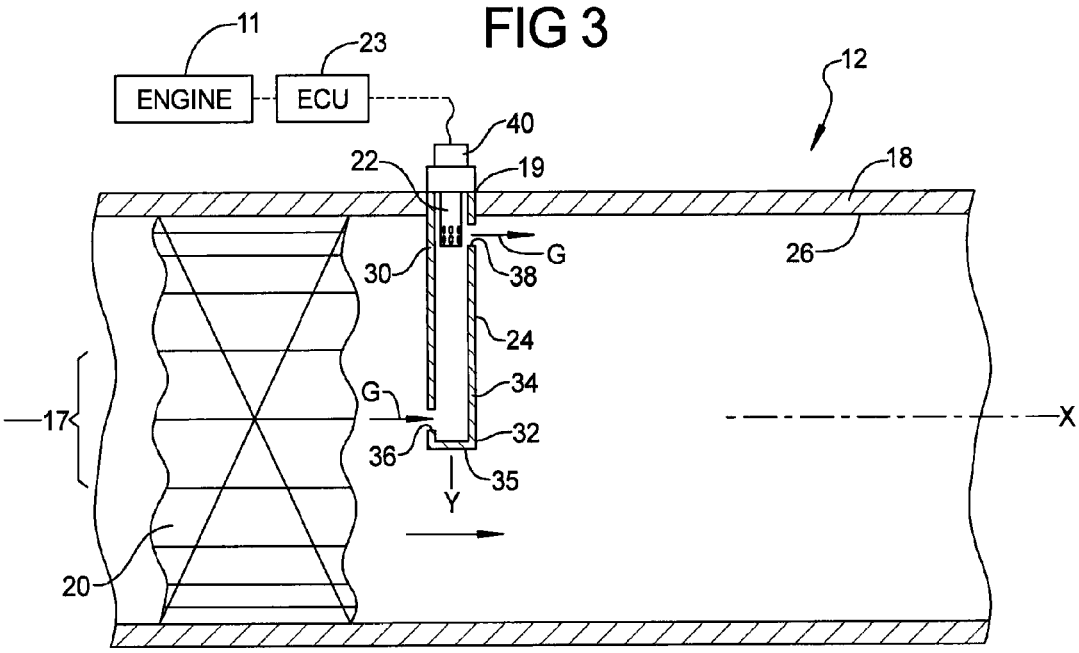
FIG. 3 is a partial section view of the exhaust assembly of FIG. 2 having a tube about a sensor in accordance with an exemplary embodiment of the present disclosure.

Referring initially to FIGS. 1 and 2, a vehicle 10 with an exhaust assembly 12 (i.e., exhaust system, etc.) is illustrated schematically. The exhaust assembly 12 can direct the flow of exhaust gas (indicated by arrows that are labeled G in FIG. 2) from an engine 11 of the vehicle 10 to an area outside the vehicle 10. Also, the exhaust assembly 12 can treat the exhaust gas G to thereby reduce emissions of certain substances in the exhaust gas G.

Although the vehicle 10 is illustrated as a passenger car, it will be appreciated that the vehicle 10 can be of any other type, such as a truck, a motorcycle, etc. Also, it will be appreciated that the engine 11 can be of any suitable type.

As shown in FIG. 2, the exhaust assembly 12 can generally include an exhaust manifold 16 that is in fluid communication with an exhaust pipe 18. The exhaust manifold 16 can direct the flow of exhaust gases G from the combustion chambers of the engine 11 into the exhaust pipe 18.

The exhaust pipe 18 can be hollow and cylindrical such that the exhaust gases G can flow therethrough. The exhaust pipe 18 can have any suitable shape and can have any suitable cross sectional shape, such as a circular cross section. Accordingly, exhaust gases G can flow through the exhaust pipe 18 including through a central region 17 of the pipe 18 (FIG. 3). As shown in FIG. 3, a central axis X of the pipe 18 can extend through the central region 17.

Furthermore, the exhaust assembly 12 can include at least one or more catalyst members 20 (e.g., catalytic converter), which is shown in phantom in FIG. 2 and is represented schematically in FIG. 3. The catalyst member 20 can be of any suitable type and can include any suitable catalyst for reducing the emission of certain substances in the exhaust gas G.

Figure 4:
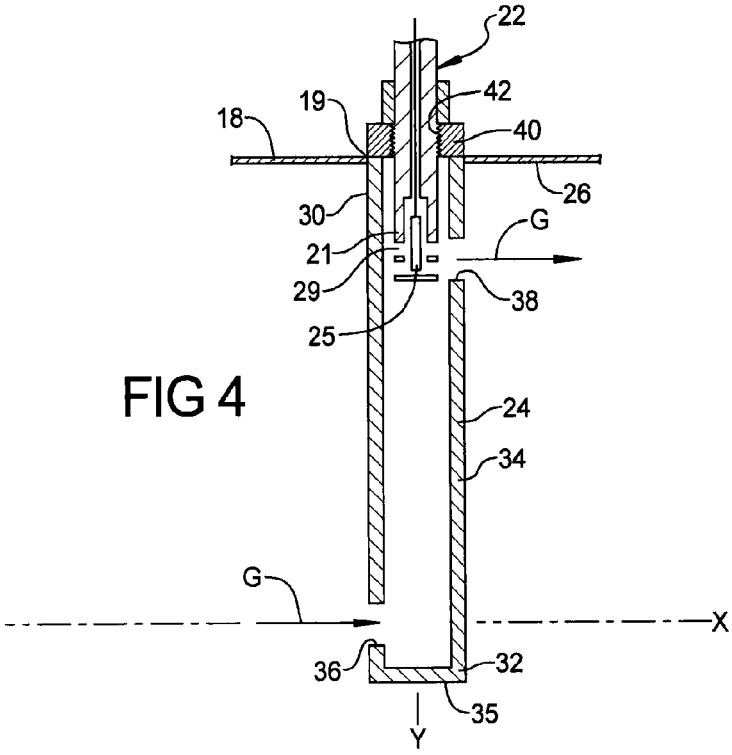
FIG. 4 is an enlarged view of the tube and sensor of FIG. 3.

In addition, the exhaust assembly 12 includes a sensor 22. As shown in FIG. 4, the sensor 22 can generally include a housing 21 with openings 29 formed therein. The sensor 22 can also include a sensing element 25 that is contained within the housing 21. In some embodiments, the sensor 22 can be a heated exhaust gas oxygen (HEGO) sensor or a universal exhaust gas oxygen (UEGO) sensor, which are commercially available, for instance, from NTK Technologies, Inc. or The Bosch Group.

Moreover, the sensor 22 can extend through an opening 19 in the wall of the exhaust pipe 18, downstream of the catalyst member 20, toward the interior of the exhaust pipe. The sensor 22 can be joined (e.g., fixed relative) to the pipe 18 in a manner discussed in greater detail below. The sensing element 25 can be disposed within the exhaust pipe 18, and the openings 29 allow fluid communication of the exhaust gas G within the pipe 18 to the sensing element 25. As shown, the sensor 22 can be disposed adjacent an inner wall surface 26 of the exhaust pipe 18 (FIG. 3). As such, the sensor 22 (and the sensing element 25) can be spaced apart at a distance from the central region 17 and the axis X of the exhaust pipe 18.

The sensor 22 can be in operative communication with a controller 23, such as the engine control unit (ECU). The sensor 22 can be of any suitable type to detect the presence or characteristic of a component in the exhaust gas G, such as an oxygen sensor. For example, the sensor 22 can detect the amount of oxygen within the flow of exhaust gases G in the exhaust pipe 18. The sensor 22 can transmit a corresponding signal (e.g., a feedback signal) to the controller 23, and the controller 23 can thereby utilize this signal to modify an operation of the engine 11. For instance, the controller 23 can adjust the injected fuel-to-air mixture, depending on the feedback signal from the sensor 22.

It will be appreciated that the sensor 22 can be of any suitable type other than an oxygen sensor and can detect other characteristics of the exhaust gas G without departing from the scope of the present disclosure. Furthermore, it will be appreciated that the sensor 22 can be disposed in any suitable location within the exhaust assembly 12 without departing from the scope of the present disclosure. In addition, it will be appreciated that the sensor 22 can provide signals relating to the exhaust gas G to any component other than an ECU, and/or the controller 23 can control components other than the engine 11.

Furthermore, the exhaust assembly 12 includes a tube 24 for directing the flow of exhaust gas G toward the sensor 22. The tube 24 is be hollow and can have any cross-sectional shape and extend along a substantially straight tube axis Y. In other embodiments, the tube axis Y can be at least partially curved along the length of the tube 24. For example as shown in FIG. 4, the tube has a generally cylindrical configuration and extends into the exhaust pipe 18 through the opening 19. The sensor 22 is received within the tube 24, and both the sensor 22 and tube 24 can be joined (e.g., fixed relative) to the exhaust pipe 18, downstream of the catalyst member 20. Thus, as will be discussed in greater detail below, the tube 24 is configured to direct the flow of exhaust gas G in the exhaust pipe 18 toward the sensor 22 such that the sensor 22 can more accurately detect the characteristics of the exhaust gases G. Accordingly, as will be discussed, the tube 24 can improve the flow of exhaust gas G to the sensor 22 for more accurate sensor gas G characterization for increasing efficiency of the engine 11 during operation.

Figure 5:
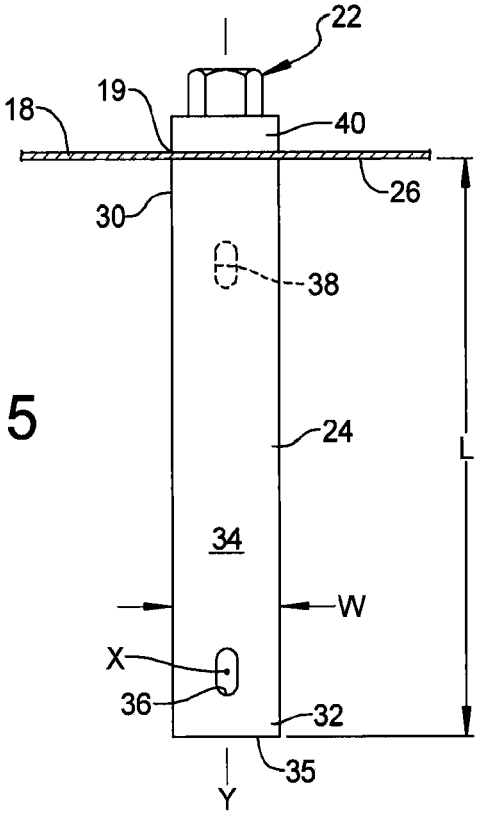
FIG. 5 is an enlarged partial view of the exhaust assembly of FIG. 2.
Figure 6:
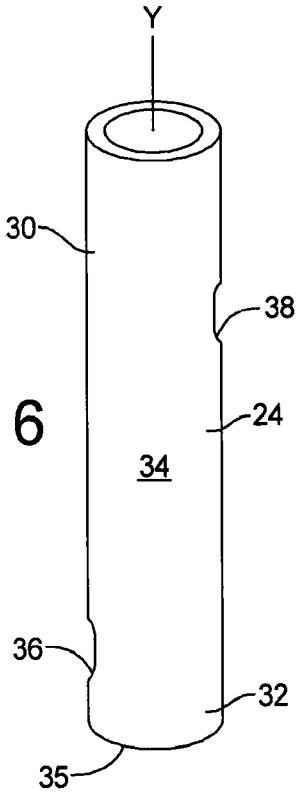
FIG. 6 is a perspective view of the tube of the exhaust assembly of FIG. 2.

Referring now to FIGS. 2-6, the tube 24 will be described in greater detail. As shown, the tube 24 has an elongated cylindrical shape. In other embodiments, the tube 24 can have a non-cylindrical shape. Also, the tube 24 can have a substantially straight length along the tube axis Y (FIGS. 3-5). However, it will be appreciated that the tube 24 can have any suitable shape, and it will also be appreciated that the tube 24 can have a non-linear tube axis Y.

As shown in FIGS. 3-5, the tube 24 is elongated and extends from a first end 30 toward a second end 32. In some embodiments, the tube 24 includes a sidewall 34 that extends substantially straight along the tube axis Y from the first end 30 toward the second end 32. The sidewall 34 can have a constant thickness along the tube axis Y, or the sidewall 34 can have a thickness that varies along the tube axis Y. The first end 30 of the tube is open to receive at least a portion of the sensor 22 therein. The second end 32 of the tube includes an end wall 35 to close that end of the tube. The end wall 35 can be substantially perpendicular to the tube axis Y.

The length and other parameters of the tube 24 can be configured to suit the particular exhaust system including the configuration of the sensor 22. In some embodiments, the length L of the tube 24 can be between approximately 2 and 3 inches (e.g., approximately 2.5 inches). Also, the width W of the tube 24 can be between approximately 0.25 and 1 inch (e.g., approximately ⅝ inches).

Moreover, the tube 24 can be made out of and/or include any suitable material. For instance, in some embodiments, the tube 24 can be made of and/or include stainless steel and/or austenitic nickel-chromium-based material (e.g., INCONEL).

Figure 7:
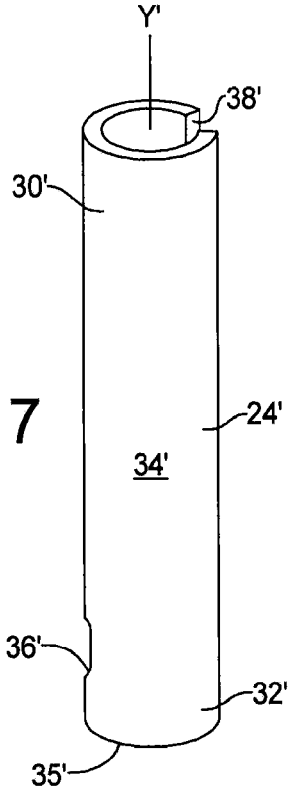
FIG. 7 is a perspective view of the tube of the exhaust assembly of FIG. 2 according to another embodiment of the present disclosure.

In addition, the tube 24 includes an inlet opening 36 and an outlet opening 38. For example and referring to FIGS. 3-5, the tube 24 includes an inlet opening 36 and an outlet opening 38, each extending through the sidewall 34. The inlet opening 36 can be disposed adjacent the second end 32, and the outlet opening 38 can be disposed adjacent the first end 30. The inlet and outlet openings 36, 38 can be disposed on opposite sides of the tube axis Y from each other. The inlet and outlet openings 36, 38 can be of any suitable shape and size. For instance, the inlet and outlet openings 36, 38 can be elongate (FIG. 5) and generally elliptical, each with a major axis extending substantially parallel to the tube axis Y. Furthermore, the inlet and outlet openings 36, 38 can be drilled holes. In an alternative embodiment, the tube 24 could be a formed material/construction where the inlet and outlet openings 36, 38 in the sidewall 34 are formed in any suitable shape during the forming process. Also, as shown in the embodiments of FIG. 7, the tube 24' can include an inlet opening 36' that is a hole through the sidewall 34' and the outlet opening 38' can be a notch in the sidewall 34' that extends along the tube axis Y' at the first end 30'. In yet another embodiment, the tube 24 includes a bent section adjacent the second end 32 where instead of a closed second end 32 (e.g. end wall 35 of FIG. 4), the second end 32 is open across the tube cross section so that open second end 32 defines the inlet opening 36 for exhaust gas G to enter the tube 24 and be directed by the tube 24 toward the sensor 22.

The sensor 22 and the tube 24 can be joined to the exhaust pipe 18 in any suitable fashion. For instance, as shown in FIGS. 3-5, the exhaust assembly 12 can include a boss 40, which is ring-shaped and that encircles the opening 19 in the exhaust pipe 18. The boss 40 can include a threaded opening 42 (FIG. 4). The sensor 22 can be threadably attached to the boss 40 via the threaded opening 42. Also, the sensor 22 can be further secured to the boss 40 via adhesives or via any suitable means. Furthermore, the tube 24 can be fixed (e.g., welded) to the boss 40. In some embodiments, the sensor 22, the tube 24, and the boss 40 can be assembled separate from the exhaust pipe 18 and the assembly can be fixed (e.g., welded to the exhaust pipe) in a subsequent manufacturing step. In other embodiments, the boss 40 and the tube 24 can be fixed to the exhaust pipe 18, and the sensor 22 can be threadably fixed to the boss 40 in a subsequent manufacturing step. Moreover, it will be appreciated that either one of the boss 40 or the tube 24 can be fixed (e.g., welded) to the exhaust pipe 18. Furthermore, in some embodiments, both the boss 40 and the tube 24 can be fixed (e.g., welded) to the exhaust pipe 18.

Therefore, as shown in FIGS. 3-5, both the sensor 22 and the tube 24 can extend into the exhaust pipe 18 such that the tube 24 is cantilevered within the exhaust pipe 18. In other embodiments, the tube 24 can extend far enough into the exhaust pipe 18 such that the tube 24 is supported at both ends 30, 32 by the exhaust pipe 18, wherein the inlet opening 36 to the tube 24 is positioned in the central region 17 of the exhaust pipe 18 so exhaust gas G from the central region 17 flows substantially directly into the inlet opening 36. Of course, in such a configuration the tube 24 may further include deflection means (e.g., baffles, fins, etc.) within the tube 24 for directing the exhaust gas G entering the inlet opening 36 toward the sensor 22.

Also, as shown, the tube axis Y can be disposed at an angle relative to the central region 17 of the exhaust pipe 18. For instance, in some embodiments, the tube axis Y and the central axis X can be disposed relatively at an angle between approximately 80° and 90°. Furthermore, in some embodiments, the tube axis Y can be substantially perpendicular to the central axis X of the exhaust pipe 18. In alternative embodiments, the tube axis Y can be disposed at other angles relative to the central region 17 of the exhaust pipe 18 to suit a particular configuration of vehicle.

In the embodiment shown, the inlet opening 36 can face substantially upstream in the flow of exhaust gas G through the central region 17 of the exhaust pipe 18, and the outlet opening 38 can face substantially downstream. Moreover, the central axis X of the exhaust pipe 18 can extend through the inlet opening 36 of the tube 24. In some embodiments, the central axis X can be coaxial with the inlet opening 36. In addition, the outlet opening 38 can be disposed adjacent the sensor 22 and adjacent the inner wall surface 26 of the exhaust pipe 18.

Thus, the inlet opening 36 is disposed substantially in the central region of the exhaust pipe 18 so the exhaust gas G can readily flow into the inlet opening 36, through the tube 24 along the tube axis Y, toward the sensor 22 where the sensor 22 detects the characteristics of the exhaust gas G. Thereafter, the exhaust gases G exit the tube 24 through the outlet opening 38 disposed adjacent the sensor 22.

It will be appreciated that the exhaust gases G may enter the tube 24 at a relatively high velocity and at a relative high-pressure where the inlet opening 36 is generally aligned with the central region 17 of the exhaust pipe 18, compared to exhaust gas G flow near the inner wall surface 26. As such, the exhaust gas G more readily is directed to flow into the inlet opening 36 and then directed through the tube 24 toward the sensor 22 for determining the characteristics of the gas G. In some embodiments, even though the sensor 22 may not be located in an area of high gas flow within the pipe 18, the tube 24 is positioned and configured to direct gas flow toward the sensor 22 for a more accurate characterization of the exhaust gases G from the central region 17 of the exhaust pipe 18. Thus, the sensor 22 can more accurately detect the characteristics of the exhaust gas G, thereby allowing the controller 23 to receive more accurate exhaust gas data for operation of the vehicle.

It will be appreciated that the tube 24 and the sensor 22 can extend into the exhaust pipe 18 at any suitable location. For instance, in some embodiments, the tube 24 and the sensor 22 can extend into the pipe 18 to be disposed within the pipe 18, upstream of the catalyst member 20. In other embodiments, the tube 24 and the sensor 22 can be embedded within the catalyst member 20. In still other embodiments, the second end 32 of the tube 24 extends into the pipe 18, and the first end 30 of the tube 24 extends out of the pipe 18 such that the first end 30 is disposed outside of the pipe 18. Also, the sensor 22 is received within the first end 30 of the tube 24 and remains wholly outside of the pipe 18. Nevertheless, the tube 24 directs gas G from the central region 17 of the pipe 18 toward the sensor 22. Also, in this embodiment, the tube 24 can include a separate outlet tube (not shown) for flow of gas G out of the tube 24 back into the pipe 18 or otherwise.

Figure 8:
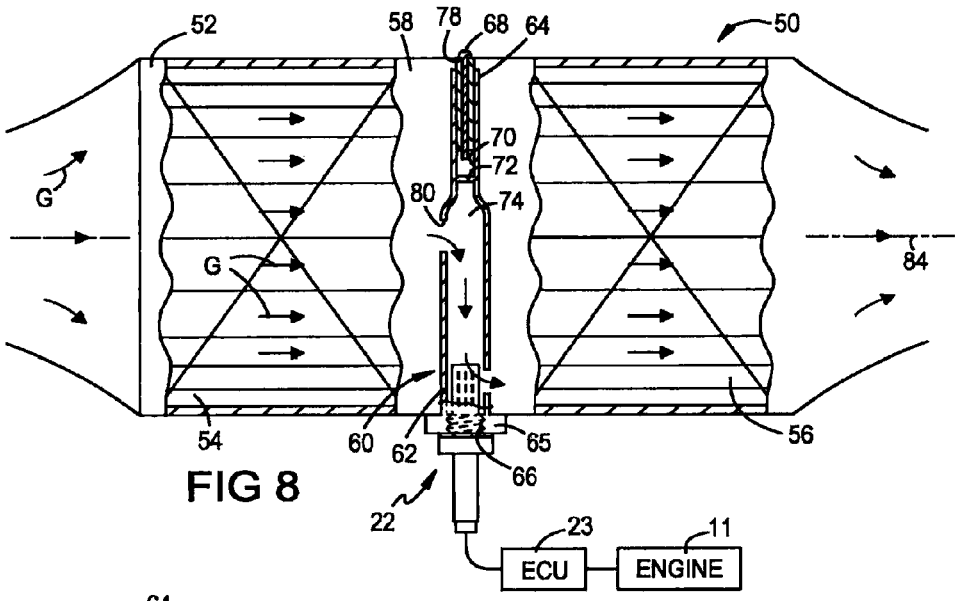
FIG. 8 is a section view of a portion of an exhaust assembly having a sensor between a pair of catalyst members within an exhaust pipe.

As shown in FIG. 8, an exhaust assembly 50 may include an exhaust pipe 52 having a section with first and second catalyst members 54, 56. In the implementation shown, a gap or at least partially open space 58 may be provided between the first catalyst member 54 and second catalyst member 56. Of course, the first and second catalyst members 54, 56 could be joined together, or they may be separate as shown in FIG. 8. In this exemplary implementation, exhaust gases flow in the direction of arrows G and so the gas flows first through the first catalyst member 54, through the open space 58 and then through the second catalyst member 56. The $O_2$ sensor 22 or other sensor may be substantially as disclosed with regard to the previously described exemplary implementations, and may be mounted to the exhaust pipe 52 in a similar manner as well.

In this implementation, a tube 60 may span the diameter of the exhaust pipe 52 and have a first end 62 adjacent to the sensor 22 and a second end 64 coupled to the exhaust pipe 52 at a location diametrically opposed to the sensor 22. Of course, the tube 60 could be bent or angled such that the second end 64 is not diametrically opposed to the sensor 22, if desired. The tube 60 may be formed in one piece with a boss 65 to which the sensor 22 is mounted, or the tube 60 may be otherwise coupled to the boss 65 or the exhaust pipe 52 at the first end 62 of the tube 60. As shown, the boss includes a threaded opening 66 to which the sensor 22 is secured.

Figure 9:
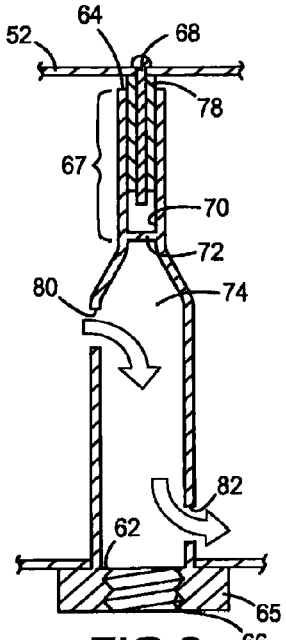
FIG. 9 is an enlarged sectional view of the tube with the sensor removed.

As shown, the second end 64 is defined in a reduced diameter section 67 (labeled in FIG. 9) of the tube 60 which may provide a reduced resistance or obstruction to gaseous flow through the space 58 in the region of the second end 64. A pin 68 or other connector may extend through the wall of the exhaust pipe 52 and into a cavity 70 defined in the second end 64 of the tube 60 to couple the tube 60 and exhaust pipe 52 together. A dividing wall 72 may separate an interior chamber 74 of the tube 60 (bounded by the sidewall of the tube) from the cavity 70 to prevent gas from escaping the interior chamber 74 of the tube through the second end 64. Instead or in addition to the dividing wall 72, a seal or plug may be provided about the pin 68 or within the cavity 70 or interior chamber 74. As shown, the pin 68 may be surrounded by an intermediate member 78 disposed within the cavity and about the pin to reduce or eliminate play or vibration between the pin 68 and tube 60 in use. The intermediate member may be formed of an intumescent material so that it expands when heated to improve its function in the cavity 70.

As in the previously described embodiments, the tube 60 may have an inlet 80 through which gas enters the interior chamber 74 and an outlet 82 from which gas leaves the interior chamber 74 and re-enters the exhaust pipe 52. The inlet 80 may be provided spaced from the sensor 22, such as generally in the middle of the exhaust pipe 52, for example, but not limited to being near a center axis 84 and the outlet 82 may be provided in the area of the sensor 22 so that exhaust gas which enters the inlet 80 is routed adjacent to and about the sensor 22 before the gas exits through the outlet 82 to the exhaust pipe 52. In this manner, gas is in the center region of the exhaust pipe 52 and downstream of the first catalyst member 54 are routed adjacent to the sensor 22 by the tube 60. Multiple inlet and outlets may be provided in the tube, as desired. This may permit sampling of exhaust gas at multiple locations including and spaced from the axis of the exhaust pipe.

Figure 10:
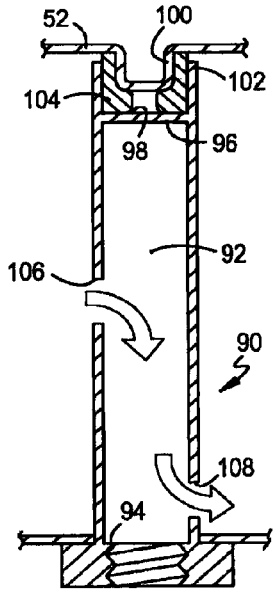
FIG. 10 is an enlarged sectional view of an alternate tube.

As shown in FIG. 10, in another exemplary form, a tube 90 may be generally cylindrical with a hollow interior chamber 92 defined between a first end 94 and a dividing wall 96 or bulk head. A cavity 98 may be provided outboard of the interior chamber 92 and wall 96 and may be adapted to receive a connector 100 to couple a second end 102 of the tube 90 to the exhaust pipe 52. In this implementation, the connector is an indentation 100 formed in the exhaust pipe 52 which extends into the cavity 98 and may be sealed or coupled thereto by an appropriate intermediate member 104 which may be formed of an intumescent material to eliminate or reduce play and vibration between the tube 90 and exhaust pipe 52 in use. The tube 90 may likewise have an inlet 106 spaced from the sensor 22 and an outlet 108, and in use, at least a portion of the sensor 22 may be disposed between the inlet 106 and outlet 108 with regard to the direction of gas flow within the tube 90. The tube 90 may be positioned within the exhaust pipe 52 and any desired location including upstream of a catalyst member 54 or 56, downstream of a catalyst member 54 or 56 or between two catalyst members 54, 56.

Figure 11:
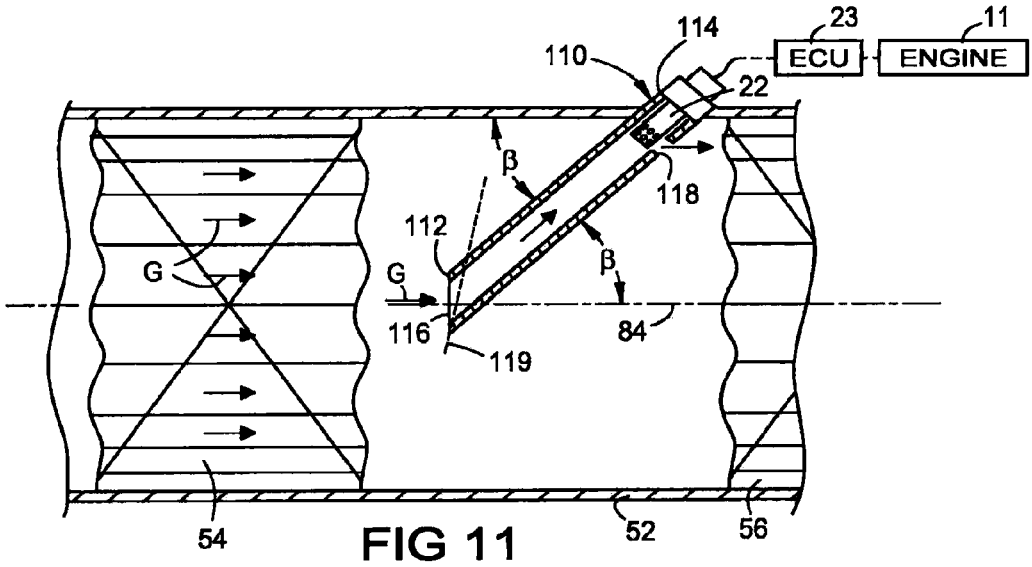
FIG. 11 is an enlarged sectional view of an inclined tube.

In another implementation, as shown in FIG. 11, a tube 110 may be inclined at an acute included angle β relative to the exhaust pipe 52 or the axis 84 of the exhaust pipe 52. In one implementation, a second end 112 of the tube 110 may be disposed upstream or advanced forward of the first end 114 of the tube 110, with respect to the direction of flow of the gas through the exhaust pipe 52 as denoted by arrows G. That is, gas flowing in the exhaust pipe would encounter the second end 112 of the tube 110 before the first end 114. An inlet 116 may be defined by an opening at the second end 112 of the tube 110, and an outlet 118 may be formed in the same manner as in previous embodiments, with at least a portion of the sensor 22 disposed between the inlet 116 and outlet 118 with respect to the flow of gas through the tube 110.

Figure 12:
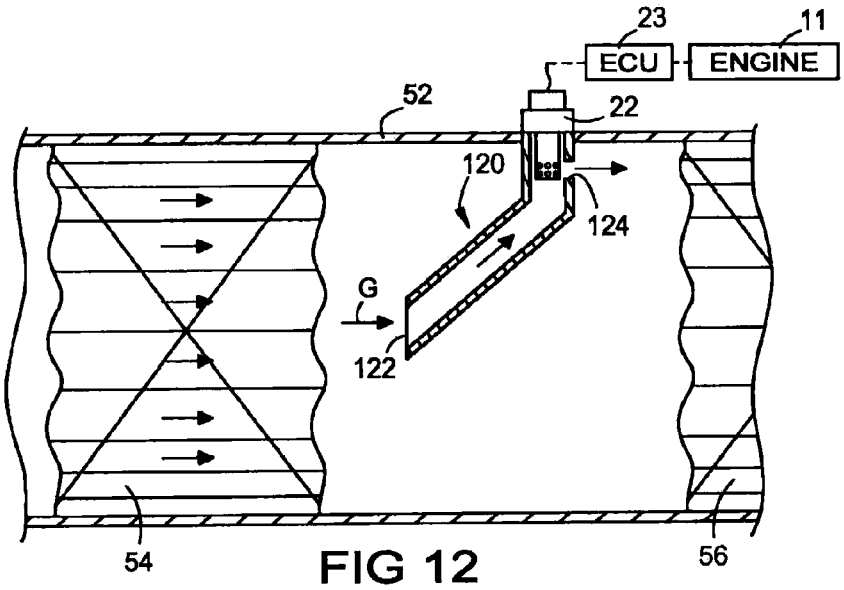
FIG. 12 is an enlarged sectional view of a bent tube.

The inlet 116 may be formed simply by an open end of the tube 110 rather than a discreet port or opening formed through a sidewall of the tube 110. The inlet 116 may be oriented generally perpendicularly to the flow of gas in the exhaust pipe 52, as shown in FIG. 11, or the inlet 116 may be oriented so that an upper portion of the tube 110 trails a lower portion of tube 110 relative to the direction of flow in the exhaust pipe 52 as shown by dashed line 119 indicating an exemplary plane along which the end of the tube 110 may be cut. This may provide a larger surface area for the inlet 116 to improve gas flow into and through the inlet. Further, because of the inclination of the tube 110, gas enters the inlet 116 more in-line with the flow of gas through the exhaust pipe 52 than in the prior embodiment where the gas is routed through the tube at a right angle to the gas flow in the exhaust pipe. In this way, gaseous flow through the tube 110 may be improved, for improved sampling of the gas by the sensor 22. While the tube 110 is shown as a straight cylindrical tube oriented at an angle to the exhaust pipe 52, a tube 120, as shown in FIG. 12, could also be bent anywhere along its length or oriented as desired with regard to the direction of gas flow through the exhaust pipe 52. In this implementation, the inlet 122 may also be disposed upstream of the outlet 124, if desired.

The above description is merely exemplary in nature and, thus, variations that do not depart from the gist of the present disclosure are intended to be within the scope of the present disclosure. Such variations are not to be regarded as a departure from the spirit and scope of the present disclosure.

What is claimed is:

1. An exhaust assembly for a vehicle, comprising:

an exhaust pipe having an interior through which an exhaust gas flows substantially in a first direction, the interior having a central region;

a sensor in fluid communication with the interior of the exhaust pipe; and a tube extending from a first end toward a second end and disposed at least partially within the interior of the exhaust pipe, the first end of the tube receiving at least a portion of the sensor and the second end of the tube being spaced from the sensor, the tube including a sidewall defining an inlet opening, an outlet opening and a chamber between the inlet opening and outlet opening, the inlet opening being spaced from the sensor and open to the interior of the exhaust pipe so that some of the exhaust gas flowing within the exhaust pipe enters the chamber, at least a portion of the sensor being located between the inlet opening and the outlet opening and in fluid communication with the chamber so that gas that enters the chamber through the inlet opening flows through the chamber, is directed by the tube toward the sensor, and then flows out of the tube through the outlet opening, wherein the inlet is a hole in the sidewall located proximate the second end; and the outlet is a notch formed in the sidewall at the first end.

2. The exhaust assembly of claim 1, further comprising a catalyst member that is disposed in the exhaust pipe upstream of the sensor and the tube.

3. The exhaust assembly of claim 1, wherein both the sensor and the first end of the tube are disposed within the exhaust pipe.

4. The exhaust assembly of claim 3, wherein the first end of the tube and the sensor are disposed adjacent an inner wall surface of the exhaust pipe.

5. The exhaust assembly of claim 2, further comprising a second catalyst member that is disposed in the exhaust pipe disposed downstream of the sensor and the tube.

6. The exhaust assembly of claim 1, wherein an axis of the tube is disposed at an angle relative to the central region of the exhaust pipe, the angle being between forty degrees(40°) and ninety degrees(90°).

7. The exhaust assembly of claim 6, wherein the tube is inclined so that the second end of the tube is advanced forward of the first end of the tube relative to the direction of gas flow through the exhaust pipe.

8. The exhaust assembly of claim 1, wherein the exhaust pipe includes an opening, each of the sensor and the tube extending into the exhaust pipe through the opening, the tube and the sensor each being joined to the exhaust pipe.

9. The exhaust assembly of claim 8, further comprising a boss that is fixed to the tube, the boss including a threaded opening, the sensor being threadably attached to the boss.

10. The exhaust assembly of claim 1, wherein the first end of the tube is connected to the exhaust pipe and the second end is disposed at the central region of the exhaust pipe.

11. The exhaust assembly of claim 1, wherein the inlet opening and the outlet opening are disposed on opposite sides of a tube axis of the tube.

12. The exhaust assembly of claim 1, wherein the sensor is an oxygen sensor.

13. The exhaust assembly of claim 1, wherein the chamber is closed outboard of the outlet opening.

14. The exhaust assembly of claim 1, wherein the second end of the tube is connected to the exhaust pipe at a location spaced from the sensor, and the inlet is located between the first end and the second end.

15. The exhaust assembly of claim 14 wherein the second end of the tube includes a cavity that receives a connector to couple the second end of the tube to the exhaust pipe.

16. The exhaust assembly of claim 15 wherein an intermediate member is disposed between the connector and the tube.

17. The exhaust assembly of claim 16 wherein the intermediate member is formed of an intumescent material.

18. The exhaust assembly of claim 15 wherein the second end of the tube is connected to the exhaust pipe at a location that is diametrically opposed to the location where the first end of the tube is connected to the exhaust pipe.

19. The exhaust assembly of claim 1, wherein the tube includes at least one of stainless steel and an austenitic nickel-chromium-based material.

20. An exhaust assembly for a vehicle comprising:

an exhaust pipe through which an exhaust gas flows, the exhaust pipe having a central axis and an inner wall surface, the exhaust pipe including an opening;

a catalyst member disposed in the exhaust pipe;

an oxygen sensor that is fixed relative to the exhaust pipe, the sensor being disposed adjacent the inner wall surface of the exhaust pipe, the oxygen sensor disposed downstream of the catalyst member; and a tube that is hollow and has a first end, a second end, and a chamber defined between the first end and the second end, the tube having a side wall defining at least part of the chamber, a wall that closes off the chamber near the second end, the first end being open to receive the sensor, the tube additionally including an inlet opening in the side wall spaced from the first end and an outlet opening in the side wall adjacent the first end, the inlet opening and the outlet opening being disposed on opposite sides of the tube axis, the tube extending through the opening in the exhaust pipe such that both the tube and the sensor extend into the exhaust pipe, the tube being fixed to the exhaust pipe to be disposed downstream from the catalyst member, the central axis of the exhaust pipe extending through the inlet opening, the tube directing flow of the exhaust gas into the inlet opening, toward the sensor, and out of the tube through the outlet opening, wherein the inlet opening a hole in the sidewall located the second end; and the outlet opening is a notch formed in the sidewall at the fist end.

* * * * *